United States Patent [19]

Hawkins et al.

[11] Patent Number: 4,814,751

[45] Date of Patent: Mar. 21, 1989

[54] PATIENT TRACKING SYSTEM

[75] Inventors: Robert E. Hawkins, Carbondale; Michael D. Burke, Murphysboro, both of Ill.

[73] Assignee: Wildlife Materials, Inc., Carbondale, Ill.

[21] Appl. No.: 212,086

[22] Filed: Jun. 27, 1988

Related U.S. Application Data

[63] Continuation of Ser. No. 19,691, Feb. 27, 1987, abandoned.

[51] Int. Cl.[4] ..... G08B 21/00; G08B 13/18

[52] U.S. Cl. ..... 340/573; 340/539; 340/572; 343/720; 343/826; 343/831; 343/893

[58] Field of Search ..... 340/573, 539, 572; 343/720, 826, 893, 831

[56] References Cited

U.S. PATENT DOCUMENTS

| | | | |
|---|---|---|---|
| 3,046,549 | 7/1962 | Kalmus | 342/385 |
| 3,115,622 | 12/1963 | Jaffe | 340/572 |
| 3,161,881 | 12/1964 | Monroe et al. | 342/435 |
| 3,366,958 | 1/1968 | Seaborn | 342/458 |
| 3,439,320 | 4/1969 | Ward | 367/191 |
| 3,478,344 | 11/1969 | Schwitzgebel et al. | 340/573 |
| 3,665,313 | 5/1972 | Trent | 340/825.49 |
| 3,766,540 | 10/1973 | Schopfer et al. | 340/568 |
| 3,868,692 | 2/1975 | Woodard et al. | 342/458 |
| 3,947,832 | 3/1976 | Rosgen et al. | 340/573 |
| 4,001,828 | 1/1977 | Culpepper | 342/446 |
| 4,021,807 | 5/1977 | Culpepper et al. | 342/458 |
| 4,023,176 | 5/1977 | Currie et al. | 342/443 |
| 4,112,421 | 9/1978 | Freeny, Jr. | 342/457 |
| 4,177,465 | 12/1979 | Lundvall et al. | 342/458 |
| 4,209,787 | 6/1980 | Freeny, Jr. | 342/457 |
| 4,225,953 | 9/1980 | Simon et al. | 367/117 |
| 4,328,487 | 5/1982 | Cheal | 340/554 |
| 4,549,169 | 10/1985 | Moura et al. | 340/573 |
| 4,593,273 | 6/1986 | Narcisse | 340/573 |
| 4,598,272 | 7/1986 | Cox | 340/573 |
| 4,598,275 | 7/1986 | Ross et al. | 340/573 |
| 4,656,463 | 4/1987 | Anders et al. | 340/521 |

*Primary Examiner*—Glen R. Swann, III

*Attorney, Agent, or Firm*—Richard C. Woodbridge

[57] ABSTRACT

A patient tracking system is employed to determine when an occupant leaves the confines of a nursing home or similar institution. Each patient has a transmitter strapped to his or her wrist which emits a signal having a distinctive radio frequency. The corridors of the nursing home include a plurality of sharp receiving antenna elements connected together in series by a coaxial cable. A scanning radio receiver is attached to the antenna system. The scanning radio receiver determines when the strength of the signal received by the antenna elements falls below a predetermined level at which point an alarm is sounded. If the alarm sounds, an attendant uses a second, directional receiver to track the patient who may have wandered away before the patient hurts himself or herself.

9 Claims, 4 Drawing Sheets

PATIENT TRACKING SYSTEM

This application is a continuation of application Ser. No. 019,691, filed 2/27/87 now abandoned.

BACKGROUND OF THE INVENTION

1. Field of the Invention

The invention comprises a sysstem for determining when a patient leaves the confines of a nursing home and then subsequently tracking that patient with a directional radio receiver.

2. Description of Related Art

Several efforts have been made to provide systems to monitor prison inmates, mental patients, elderly in nursing homes, individuals lost in avalanches, dogs, etc. through the use of radio transmitter and receiver systems. Many of the systems are complex and/or unreliable. In addition, several are very expensive to implement. Typical of known systems is the device described in U.S. Pat. No. 3,478,344 entitled BEHAVIORIAL SUPERVISION SYSTEM WITH WRIST CARRIED TRANSCEIVER. According to that disclosure an individual requiring supervision wears a radio on his wrist. The system detects when the supervised individual leaves the confines of a certain area.

U.S. Pat. No. 4,225,953 describes another device for pin-pointing the location of an individual in a building having a plurality of rooms. While that system appears to have the capability of determining the location of a person in a building, it does not appear to be useful for determining if an individual has left the structure.

U.S. Pat. No. 3,439,320 appears to be similar to the invention described in the foregong U.S. Pat. No. 4,225,953.

U.S. Pat. No. 4,177,465 is of note in that it describes a near-range personnel beacon locator in which the flash rate of a light emitting diode indicator is proportional to the distance that the locator apparatus is to an activated beacon.

U.S. Pat. No. 3,665,313 describes a method for identifying the location of aircraft and the like given a system in which a variety of different ground transmitters produce unique coded signals so that the aircraft can triangulate its location with respect to a specific ground transmitter.

U.S. Pat. Nos. 4,112,421 and 4,209,787 describe other methods and apparatuses for determining the location of police cars within a grid network. The power level of the signal at various different locations in the grid is used to determine the likely location of the mobile police transmitters.

U.S. Pat. Nos. 4,001,828 and 4,023,176 are of interest in that they describe beacon tracking systems in which a directional receiver is used to determine the location of a transmitted signal.

The following U.S. patents are cited as showing other systems of possible relevance: U.S. Pat. Nos. 3,046,549; 3,161,881; 3,366,958; 3,766,540; 3,868,692 and 4,021,807.

While the foregoing references may be relevant to the present invention, it is clear that none of the prior art, taken singularly or in combination, teaches, hints or suggests the very economical and dependable system taught in this disclosure.

SUMMARY OF THE INVENTION

Briefly described the invention comprises a system for determining if an individual in a nursing home leaves that environment and for subsequently tracking that individual with a directional radio receiver. One of the major problems in today's society is that more and more people are becoming elderly. As a consequence, more of our elderly are being cared for in nursing homes or minimum supervision facilities. It is common for elderly patients to wander away from nursing homes and, unfortunately, a number of such individuals become lost and die as a result. Several attempts have been made to use radio transmitters and/or receivers for the purpose of monitoring institutionalized individuals. Unfortunately, very few of those systems have become commercially accepted because of their expense and unreliability. The present invention allows elderly patients to be safely monitored and subsequently tracked if they should wander away from a nursing home. This system is more dignified for the elderly patient since it requires minimal personal supervision. That features coupled with the dependability and economics of the present system make it an eminently acceptable one for use in nursing homes and in other environments where supervision of institutionalized individuals is required.

According to the preferred embodiment of the invention, each elderly patient is equipped with a radio transmitter attached to his or her wrist. Each transmitter produces a distinctive radio signal at a unique predetermined frequency. A plurality of short antenna elements is connected together in series by a long non-radiating non-receiving coaxial cable. The receiving elements are located in the vicinity of the area to be supervised. A radio receiver is connected to the antenna cable and includes the ability to determine when the signal strength received by the antenna elements falls below a predetermined threshhold. The radio receiver also includes a scanning mechanism so that the distinctive patient frequencies are monitored on a periodic basis. If a patient should leave the vicinity of the nursing home, the scanning receiver will detect the fall off of the received signal and sound an audible alarm. The staff of the hospital can then track the missing patient with a portable directional receiver. In this manner, missing patients can be detected quickly and located before they do any significant harm to themselves.

These and other features of the invention will be more fully understood by reference to the following drawings.

DETAILED DESCRIPTION OF THE INVENTION

During the course of this description like numbers will be used to identify like elements according to the different figures which illustrate the invention.

Figure 1A:
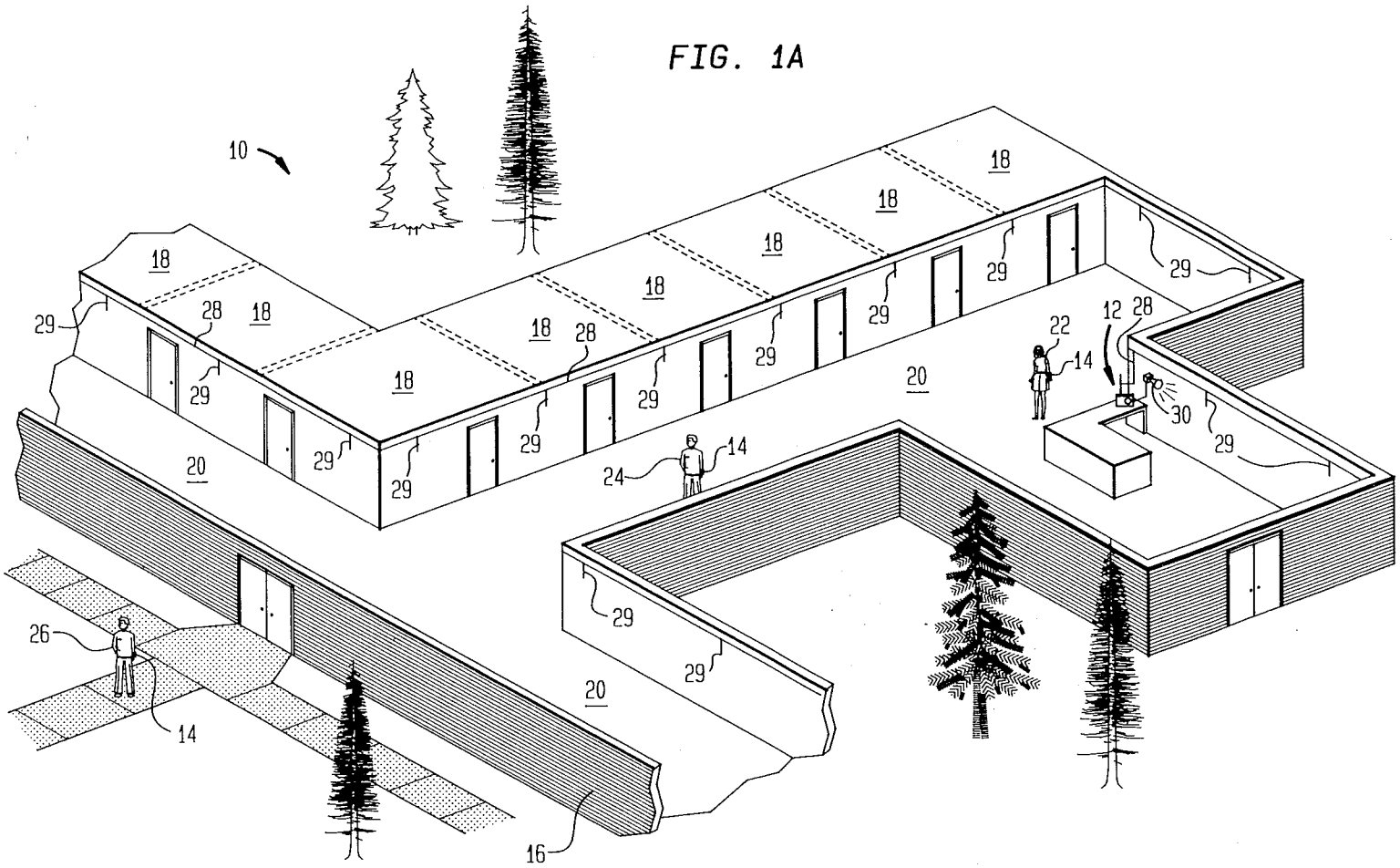
FIG. 1A illustrates the preferred embodiment of the invention as employed in a nursing home.

The preferred embodiment of the invention 10 illustrated in FIG. 1A is shown in the context of a nursing home 16. A scanning radio receiver 12 is employed to monitor the location of nursing home patients 22, 24 and 26 each of whom is equipped with a wrist transmitter 14. The details of wrist transmitter 14 are described subsequently with respect to FIGS. 2 and 3. A typical nursing home 16 includes a plurality of patient rooms 18 connected by a monitored hallway 20.

Scanning receiver 12 is connected by a non-receiving, non-radiating coaxial cable 28 to a plurality of short vertical antenna elements 29 spaced at regular intervals along the monitored hallway 20. Receiving antennas 29 pick up radio signals from wrist transmitters 14 as long as the patients 22, 24 and/or 26 are within the surveillance area of the hallway 20 or in their rooms 18. The effective range of antenna elements 29 is equal to a radius of 25 to 30 feet from each element 29 thereby permitting coverage of hallway 20 and rooms 18. Each radio transmitter 14 is tuned to transmit at a unique distinctive signal frequency. Alternatively the radio signal produced by transmitters 14 could be of the same frequency but with a uniquely characteristic code. Scanning radio 12 periodically scans the frequencies transmitted by wrist transmitters 14 to determine if any of the patients 22, 24 or 26 have left the surveillance areas 18 and 20. Patients 22 and 24 are shown in the hallway 20 and therefore their signals would be picked up by scanning receiver 12. However, patient 26 who has wandered outside of the walls of the nursing home 16 would not be detected by scanning receiver 12. Under those circumstances the scanning receiver 12 would note that the signal from the wrist transmitter 14 of patient 26 had fallen below the predetermined level receivable by antennas 29 and as a consequence would activate alarm transducer 30 notifying the staff that the patient 26 had wandered from the home 16. A LED display 49 (FIG. 4) in scanning receiver 12 will display the frequency of the transmitter 14 of patient 26 so that patient 26 can be identified by name.

Figure 1B:
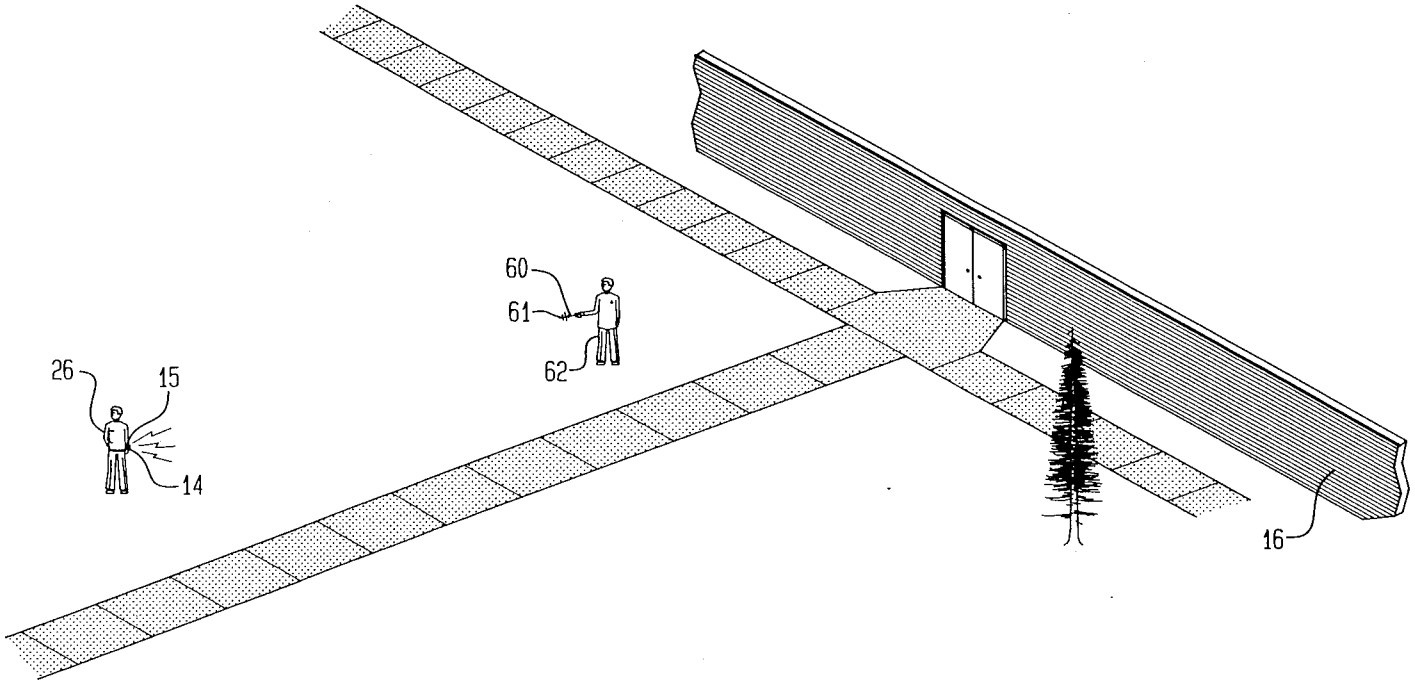
FIG. 1B illustrates how a patient is tracked with a directional radio receiver after leaving the environment of a nursing home such as shown in FIG. 1A.

If a patient 26 wanders outside of nursing home 16 it is possible to track that individual 26 with a directional radio receiver such as the commercially available FALCON V TM or TRX-1000S TM manufactured and sold by Wildlife Materials, Inc., Route 1, Giant City Road, Carbondale, Ill. 62901. Directional radio receivers of this sort are known primarily for tracking wildlife species, hunting dogs and the like equipped with radio transmitting collars. FIG. 1B illustrates the situation in which a nursing home attendant 62, equipped with a directional radio receiver 60 such as the FALCON V TM or TRX-100S TM, locates a patient 26 who has wandered away from nursing home 16. The technique employed for searching would be essentially identical to that employed by individuals using directional radio finders to locate wildlife species on research projects, missing hunting dogs and the like.

Figure 2:
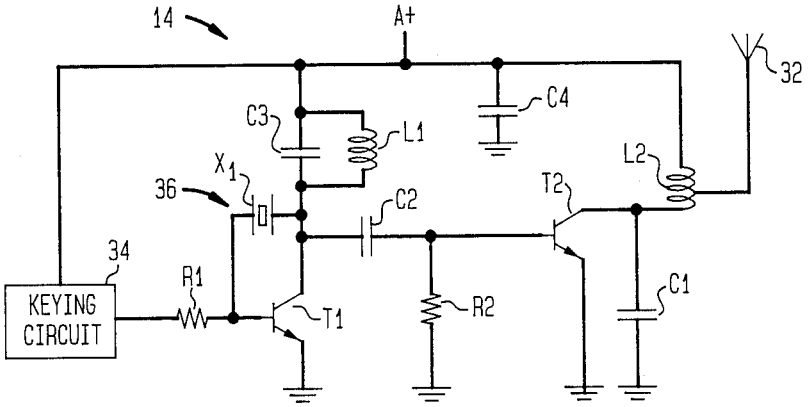
FIG. 2 is a detailed schematic diagram of a wrist transmitter.
Figure 3:
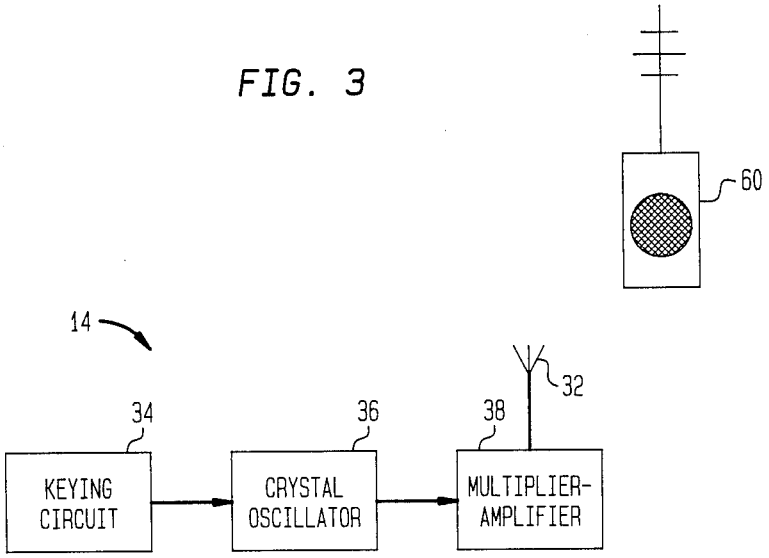
FIG. 3 is a block schematic diagram of a wrist transmitter.

FIGS. 2 and 3 illustrate the details of a typical wrist transmitter unit 14. Each transmitter 14 includes a keying circuit 34, a crystal oscillator 36 and a multiplier amplifier circuit 38. The frequency of crystal oscillator 36 is typically 50–82 mHz. Transistor $T_2$ is part of the multiplier amplifier circuit 38. For example, a 72 mHz output from oscillator 36, if trippled by multiplier amplifier 38, produces a 216 mHz output (72 mHz×3=216 mHz). This frequency is acceptable to the FCC for telemetry purposes. The keying circuit 34 could comprise a CMOS chip or a standard RC time delay circuit. Preferably it comprises a 475 K ohm to 1.5 meg ohm resistor in series with a 1–2.2 microfarad electrolytic tantalum capacitor connect between the A+ supply and circuit ground. The node between the keying circuit resistor and capacitor is connected to Resistor $R_1$ attached to the base of transistor $T_1$. The charging and discharging of the keying capacitor controls the on and off time (i.e. pulse duration) of the CW pulse whereas the frequency of the CW pulse is controlled by crystal $X_1$ and the tank circuit comprising $L_1$ and $C_3$. An antenna 32 is connected to the output multiplier amplifier circuit 38. A conventional wrist band 15 (FIG. 1B), such as used on a wrist watch, is employed to attach the transmitter 14 to the wrist of patients 22, 24 and 26. Antenna 32 could be incorporated into the wrist band or alternatively, might extend slightly beyond the chassis of the transmitter 14. Transmitter 14 provides a regular pulsed continuous wave (C.W.) output with a typical on time (i.e. pulse duration) of 20–50 milliseconds and a typical time between pulses of 1 to 2 seconds. The transmitters 14 are preferably wrist mounted but could be pin or pendant mounted or mounted on a belt. The values of the circuit elements in FIG. 2 are as follows:

| Element No. | Value |
|---|---|
| Keying circuit | Discussed above |
| R1 | 4.7k, ⅛ watt |
| R2 | 4.7k, ⅛ watt |
| T1 | SMT-1157 (Motorola) |
| T2 | MMBR-920 |
| L1 | .33 mh |
| L2 | .05–.15 mh |
| C1 | .5–3 pf |
| C2 | 15 pf |
| C3 | 15 pf |
| A+ | 2.8–3.0 V |
| Crystal 36 | HC-45/U (Sentry Model SGP45) |

Figure 4:
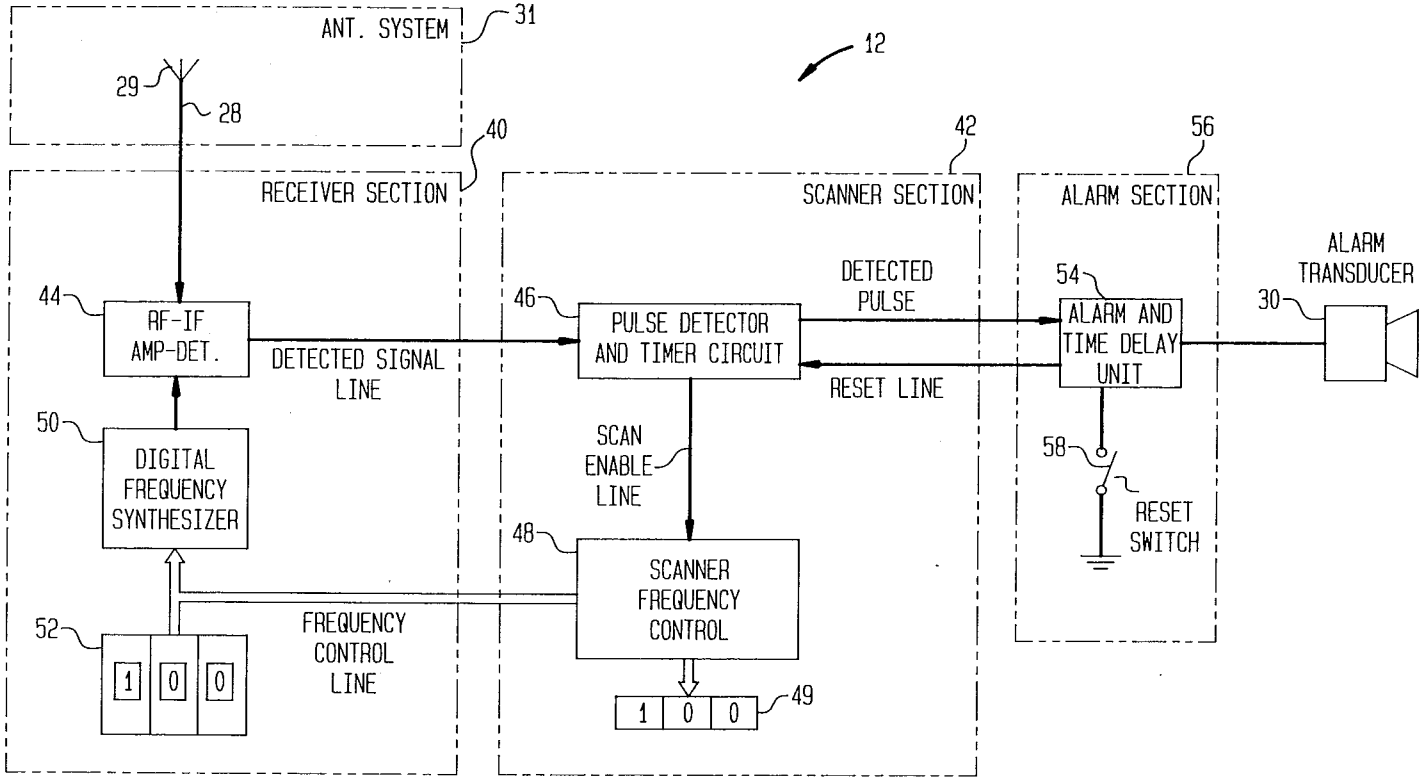
FIG. 4 is a schematic diagram of the scanning receiver circuit.

The scanning receiver system 12 according to the preferred embodiment of the invention 10 is illustrated in FIG. 4. Receiver scanner 12 includes an antenna system 31, a receiver section 40, a scanner section 42, an alarm section 56 and an alarm transducer 30. Antenna system 31 comprises a plurality of vertical receiving elements 29 connected together by a non-receiving coaxial cable 28 in the manner illustrated in FIG. 1A. Antenna elements 29 are connected by coaxial cable 28 to the RF-IF Amplitude Detector circuit 44 of the receiver section 40. The detected signal line from RF-IF circuit 44 provides an input to the pulse detector and timing circuit 46 of scanner section 42. If the pulse detector and timing circuit 46 detects a given frequency it enables the scanner frequency control circuit 48 thereby causing the digital frequency synthesizer 50 to step to the next frequency. Digital frequency synthesizer 50 provides an input to the RF-IF unit 44 whose tuned frequency changes as a result thereof. Frequency selection switch assembly 52 is employed to program the scanner frequency control circuit 48 to the frequencies of the various transmitters 14. For example, if there were twenty-five patients each wearing a transmitter 14 having a different radio frequency signal, then frequency select circuit 52 would be employed to input 25 different scanned frequencies into the scanner frequency control 48. The signal receiving threshold of scanning receiver system 12 is determined by the gain control of the RF-IF amplitude detector unit 44 and the threshold adjustment of the pulse detector and timer circuit 46. The threshold of circuit 46 may be adjusted by an adjustment control located on the front panel of scanner section 42. Each time the pulse detector circuit 46 detects the presence of a given frequency as received by antenna elements 29, it enables the scanner frequency control 48 to index to the next frequency and that stepping cycle continues indefinitely until the pulse detector circuit 46 does not detect the presence of a given frequency signal. If a signal is not detected, the pulse detector circuit 46 disables scanner frequency control 48 and enables alarm and time dely unit 54. After a predetermined period of time, the alarm unit 54 causes transducer 30 to emit an audible alarm signal. At the same time light emitting diodes (LEDs) in the scanner frequency readout 49 will indicate the frequency that was not detected. Scanner frequency readout 49 comprises a group of LEDs driven by scanner frequency control 48 and mounted on the front panel of scanning section 42. Since each patient has a unique radio frequency signal, it is possible to determine which of the 25 patients has left the surveillance area of the room 18 and hall 20. As previously described, if a patient is missing a nursing home attendant 62 will typically leave the premises 16 with a directional radio receiver 60 similar to the Wildlife FALCON V TM or TRX-1000S TM directional radio receiver. Radio receiver 60 includes a directional antenna 61 which produces a peaked signal when correctly aimed in the direction of wrist transmitter 14. Tracking techniques similar to those used to locate lost hunting dogs having radio transmitting collars are then employed to find the missing patient 26 before he or she has an opportunity to do serious damage to him or herself. Once the patient 26 is located, the attendant 62 returns and closes reset switch 58 which transmits a signal from alarm and time delay unit 54 along a reset line to pulse detector circuit 46 causing the alarm and time delay unit 54 to turn off. This in turn disables the alarm transducer 30 causing the receiver scanner 12 to return to its normal search scan mode until disrupted by another similar event.

The alarm and delay unit 54 serves the purpose of activating alarm transducer 30 and providing a delay of about 20 seconds before alarm transducer 30 is sounded. If the scanning receiver 12 scans once a second, then it may wait for as many as 20 missing pulses before sounding alarm transducer 30. The delay helps to avoid false alarms which might be caused by a transmitter 14 passing through a dead zone or by a non-receiving orientation of the transmitter and receiving antennas or by a person temporarily leaving the surveillance areas 18 or 20. The time delay could be provided by a conventional timer, an RC circuit or a pulse counter or similar device.

The scanner receiver system 12 includes modified subcomponents taken from a FALCON V TM tracking receiver combined with an APS-164 scanner and an alarm. The basic FALCON V TM receiver and the APS-164 scanning attachment are commercially available from Wildlife Materials, Inc., Route 1, Carbondale, Ill. 62901. The receiver system 12 scans through the frequencies of the programmed transmitters 14, waiting on each channel for several of the 20–50 ms pulses to be received before moving on to the next channel. If no pulses are received from a given transmitter 14 (i.e. complete absence of signal), the receiver scanner 12 waits approximately 20 seconds and then activates the alarm transducer 30. The scanner receiver 12 will not move on to other channels until the alarm unit 54 is deactivated.

The major components of the receiver/scanner system 12 are set forth below:

| Component | Model Number or Value |
|---|---|
| RF-IF Amplitude Detector Section 44 | Front end of FALCON $V^{tm}$ by Wildlife Materials, Inc. |
| Pulse Detector and Timer Circuit 46 | APS-164 Scanner by Wildlife Materials, Inc. |
| Scanner Frequency Control 48 | APS-164 Scanner by Wildlife Materials, Inc. |
| Digital Frequency Synthesizer 50 | FALCON $V^{tm}$ Subcomponent by Wildlife Materials, Inc. |
| Frequency Select Control 52 | 3 Deck BCD pushbutton switches |
| Alarm and time delay Unit 54 | Alarm Circuit with Pulse Counter Time Delay |
| Reset Switch 58 | DPDT Slide Switch on APS-164 Scanner Front Panel |
| Alarm Transducer 30 | Sonalert Alarm Unit |

The antenna system 31 is an important part of the overall invention 10. Each element 29 is about 3"–4" long and preferably comprises a stripped section of coaxial cable. Elements 29 are usually shorter than one quarter of a wavelength and are essentially stub tuned sections connected to coaxial cable 28 by conventional signal splitter/combiner units. Antenna 31 is essentially a distributed antenna having overlapping 25'–30' zones of coverage. It is especially suited for use in the invention 10 because it has a well defined aperture. That is to say it thoroughly covers the area it is supposed to cover and the area of coverage falls off rapidly outside of the walls 16 of the nursing home. By connecting elements 29 together by coaxial cable 28 it is possible to minimize signal loss and interference since the coaxial cable is shielded from spurious signal pick up. Accordingly, it is relatively easy to match the antenna elements 29 to the scanner receiver 12.

The invention 10 has been described primarily in the context of a nursing home monitor. It is possible that the technique could also be employed to supervise other individuals such as inmates in a penal institution, children, hospitalized patients, home confined individuals, etc. The system has also been described in the context of individual transmitters 14 which produce a distinctive radio frequency output signal characteristic of one and only one transmitter. It is also possible for all the transmitters 14 to transmit on the same frequency but employ a different coded signal that could be recognized by a scanning receiver 12 having the capability of distinguishing between coded signals at the same frequency.

While the invention has been described with reference to the preferred embodiment thereof it will be appreciated by those of ordinary skill in the art that various changes can be made to the parts and construction of the invention without departing from the spirit and scope of the invention as a whole.

We claim:

1. A person monitoring system comprising:

a plurality of radio transmitters each of which transmits a radio signal at a different frequency, each radio transmitter including a strap-like body attaching means for attaching said transmitter to the limb of a human body so that no more than one radio transmitter is attached to each of said human bodies;

receiver means for receiving each different frequency and for detecting when the strength of any of said different frequencies drops below a pre-determined level;

scanner means for causing said receiver means to periodically search each different frequency respectively;

alarm means for producing an alarm after the signal strength of a signal at a specific frequency falls below said pre-determined level; and, antenna means connected to said receiver means and located in the vicinity of a specific surveillance area for picking up each different frequency, said antenna means comprising at least two branches each branch including a plurality of signal receiving elements, each said signal receiving element comprising a length of wire connected at one end only to one of said branched such that each signal receiving element has an individual surveillance area, wherein at least some of the individual surveillance areas of said signal receiving elements overlap each other to form a larger, extended surveillance area.

2. The system of claim 1 further including:

portable directional receiver means for detecting the location of a transmitter whose signal is not detected within said surveillance area.

3. The system of claim 1 wherein said alarm means comprises an audible alarm.

4. The system of claim 3 wherein said surveillance area comprises an area inside a nursing home.

5. The system of claim 1 wherein said radio transmitters comprise:

an oscillator for producing a continuous wave signal;

a keying circuit means for periodically turning said oscillator circuit on and off thereby producing a pulsed continuous wave signal; and, multiplier means for multiplying the frequency of said pulsed continuous wave signal to produce an output pulsed continuous wave signal having a frequency greater than the signal from said oscillator.

6. The system of claim 5 further comprising:

an alarm and time delay means connected between said scanner means and said audible alarm for actuating said audible alarm a predetermined period of time after said receiver means fails to detect a given distinctive radio signal, wherein said predetermined period of time comprises an interval greater than at least two pulse duration periods and wherein said alarm and time delay means helps to prevent false alarms due to the temporary non-detection of a given distinctive radio signal.

7. The system of claim 6 further comprising:

reset means for manually resetting said scanner means after said alarm and time delay means has activated said audible alarm.

8. The system of claim 1 wherein said lengths of wire are at least 3 inches long.

9. The system of claim 1 wherein said lengths of wire are shorter than one quarter of a wavelength of each different frequency received and comprise stub tuned sections connected to said coaxial cable.

* * * * *

UNITED STATES PATENT AND TRADEMARK OFFICE

CERTIFICATE OF CORRECTION

PATENT NO. : 4,814,751

DATED : March 21, 1989

INVENTOR(S) : Robert E. Hawkins and Michael D. Burke

It is certified that error appears in the above-identified patent and that said Letters Patent is hereby corrected as shown below:

IN THE ABSTRACT:

Line 6, correct the word "sharp" to read --short--.

IN THE BACKGROUND OF THE INVENTION:

Col. 1, line 9, correct the word "sysstem" to read --system--;

Col. 1, line 34, correct the word "foregong" to read --foregoing--;

Col. 2, line 18, correct the word "That" to read --These--.

Signed and Sealed this

Twenty-third Day of January, 1990

*Attest:*

JEFFREY M. SAMUELS

*Attesting Officer* *Acting Commissioner of Patents and Trademarks*